US006733073B2

(12) United States Patent
Whiteside et al.

(10) Patent No.: US 6,733,073 B2
(45) Date of Patent: May 11, 2004

(54) CHAIR FOR A MECHANIC

(75) Inventors: Kirt E. Whiteside, Marion, OH (US); Terry L. Whiteside, Delaware, OH (US); W. Gordon Dallas, Ashland, OH (US)

(73) Assignee: Whiteside Mfg. Co., Delaware, OH (US)

( * ) Notice: Subject to any disclaimer, the term of this patent is extended or adjusted under 35 U.S.C. 154(b) by 0 days.

(21) Appl. No.: 09/797,552

(22) Filed: Mar. 2, 2001

(65) Prior Publication Data

US 2002/0121801 A1 Sep. 5, 2002

(51) Int. Cl.[7] ..... A47C 7/62

(52) U.S. Cl. ..... 297/188.08; 211/119.07; 211/70.6; 297/173; 280/32.6; 312/235.2

(58) Field of Search ..... 297/188.08, 173, 297/188.12, 188.2, 188.21, 24, 56, 149, 155, 158.2, 160, 161, 162, 163; 280/32.5, 32.6, 47.34, 47.35, 79.11, 79.2, 79.3; 312/235.2, 235.5, 249.8, 209, 265.4, 296, 326, 329; 211/87.01, 119.004, 119.007, 70.6; D6/336; 108/94

(56) References Cited

U.S. PATENT DOCUMENTS

| | | | | | |
|---|---|---|---|---|---|
| 434,713 | A | * | 8/1890 | Jacob | |
| 2,058,263 | A | * | 10/1936 | Rosendale | |
| 2,300,405 | A | * | 11/1942 | Cook | |
| 2,663,608 | A | * | 12/1953 | Schauer | |
| 2,765,025 | A | * | 10/1956 | Bakalic et al. | 297/188.08 |
| 2,798,732 | A | * | 7/1957 | Craig | 280/47.35 |
| 2,928,145 | A | * | 3/1960 | Foley | |
| 2,932,545 | A | * | 4/1960 | Foley | |
| 3,331,648 | A | * | 7/1967 | Petkwitz et al. | |
| 4,102,549 | A | * | 7/1978 | Morrison et al. | |
| 4,169,625 | A | * | 10/1979 | Petersen | |
| 4,767,159 | A | * | 8/1988 | Opsvik | 297/423.1 |
| 5,069,464 | A | * | 12/1991 | Braconnier | 280/47.35 |
| 5,169,210 | A | * | 12/1992 | Fricano | 297/188.2 X |
| 5,364,137 | A | * | 11/1994 | Shimer | 297/327 |
| D353,058 | S | | 12/1994 | Dallas | D6/336 |
| D365,935 | S | | 1/1996 | Dallas | D6/336 |
| 5,634,649 | A | * | 6/1997 | Breining et al. | 280/47.35 |
| 5,653,499 | A | * | 8/1997 | Goodall | 297/170 |
| 5,660,432 | A | * | 8/1997 | Davis | 297/188.2 X |
| 5,662,396 | A | * | 9/1997 | Reeder et al. | 312/209 |
| D410,128 | S | | 5/1999 | Dallas et al. | D34/23 |
| 6,010,187 | A | | 1/2000 | Dallas et al. | 297/188.08 |
| 6,086,073 | A | * | 7/2000 | Tisbo et al. | 280/47.26 |
| 6,124,387 | A | * | 9/2000 | Wang et al. | 297/188.18 |
| 6,264,026 | B1 | * | 7/2001 | Bradley | 206/217 |

OTHER PUBLICATIONS

BioFit Engineered Seating, advertising catalog, 16 pages (undated).
Rel Products Incorporated, advertising brochure, 3 pages (undated).
Lift Omega Equipment, advertisement, 1 page (undated).
Whiteside Mfg. Co., product catalog; 1 page (2000).

* cited by examiner

*Primary Examiner*—Peter M. Cuomo
*Assistant Examiner*—Stephen Vu
(74) *Attorney, Agent, or Firm*—Renner, Kenner, Greive, Bobak, Taylor & Weber

(57) ABSTRACT

A mobile chair (10) includes a padded seat portion (12) which carries a backrest portion (13). At least five legs (15) support the underside of the seat portion (12) and are each provided with a caster assembly (16). A shelf (22) is carried by the legs (15) near the bottom thereof. A tray assembly (24) is pivotally carried on one of the legs (15) and is attachable to an adjacent leg (15) by a magnet (30) or the like.

13 Claims, 3 Drawing Sheets

CHAIR FOR A MECHANIC

TECHNICAL FIELD

This invention relates to a chair particularly adapted for use by a mechanic. More particularly, this invention relates to a wheeled chair which is extremely stable and which is provided with a plurality of trays for the readily accessible storage of items.

BACKGROUND ART

Mechanics and other workmen often use devices which provide them with a degree of comfort, and yet provide them with mobility, while working on an automotive vehicle or other object. For example, a mechanic, when working on an area with little headroom, such as underneath a vehicle, may use a creeper wherein the mechanic lies prone on the creeper and maneuvers himself to the area of the vehicle to be worked upon. Where headroom is not a concern, a mechanic is often provided with a chair upon which he may rest, and yet move around, while performing his duties.

However, prior art chairs for mechanics are subject to several deficiencies. For example, normally such chairs are provided with four conventional castered legs to render the chair moveable. However, when, as is often the case, the mechanic is required to shift his weight or otherwise lean to gain better access to a work site, such chairs may have a tendency to roll or tip dependent on the orientation of the wheels of the casters.

Moreover, the obvious purpose of such a chair is to provide comfort and convenience to the mechanic while servicing a vehicle. But if the user must get up and down out of the chair to locate tools which may be necessary for his trade, the purpose of the chair is somewhat eliminated. While some prior art chairs have provided some type of integral tool storage capacity, the provision of such has been with undue complexity requiring a number of additional operating parts thereby significantly adding to the cost of the product.

The need exists, therefore, for a chair for a mechanic which is stable, which can provide means to store a variety of tools for facile access by the mechanic, and which can be efficiently and economically manufactured.

DISCLOSURE OF THE INVENTION

It is thus an object of the present invention to provide a wheeled chair which is stable and less susceptible to tipping or the like than the prior art.

It is another object of the present invention to provide a chair, as above, with at least five legs, each of which supports the underside of a seat, and each of which carries a caster.

It is a further object of the present invention to provide a chair, as above, in which a shelf may be carried by the legs.

It is an additional object of the present invention to provide a chair, as above, in which tool storage trays may be pivotally carried by a leg of the chair.

These and other objects of the present invention, as well as the advantages thereof over existing prior art forms, which will become apparent from the description to follow, are accomplished by the improvements hereinafter described and claimed.

In general, a chair made in accordance with a concept of the present invention includes a seat portion having an upper and lower surface and a backrest extending upwardly from the upper surface of the seat portion. A plurality in excess of four legs each have a caster assembly at one end thereof and are configured so as to be attached at their other end to the underside of the lower surface of the seat portion.

In accordance with another aspect of the present invention, a chair includes a seat portion with a backrest portion extending upwardly therefrom. A plurality of legs to carry the seat portion. A tray assembly is pivotally carried by one of the legs and is attachable to a leg which is adjacent to the leg pivotally carrying the tray assembly.

A preferred exemplary chair for a mechanic incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
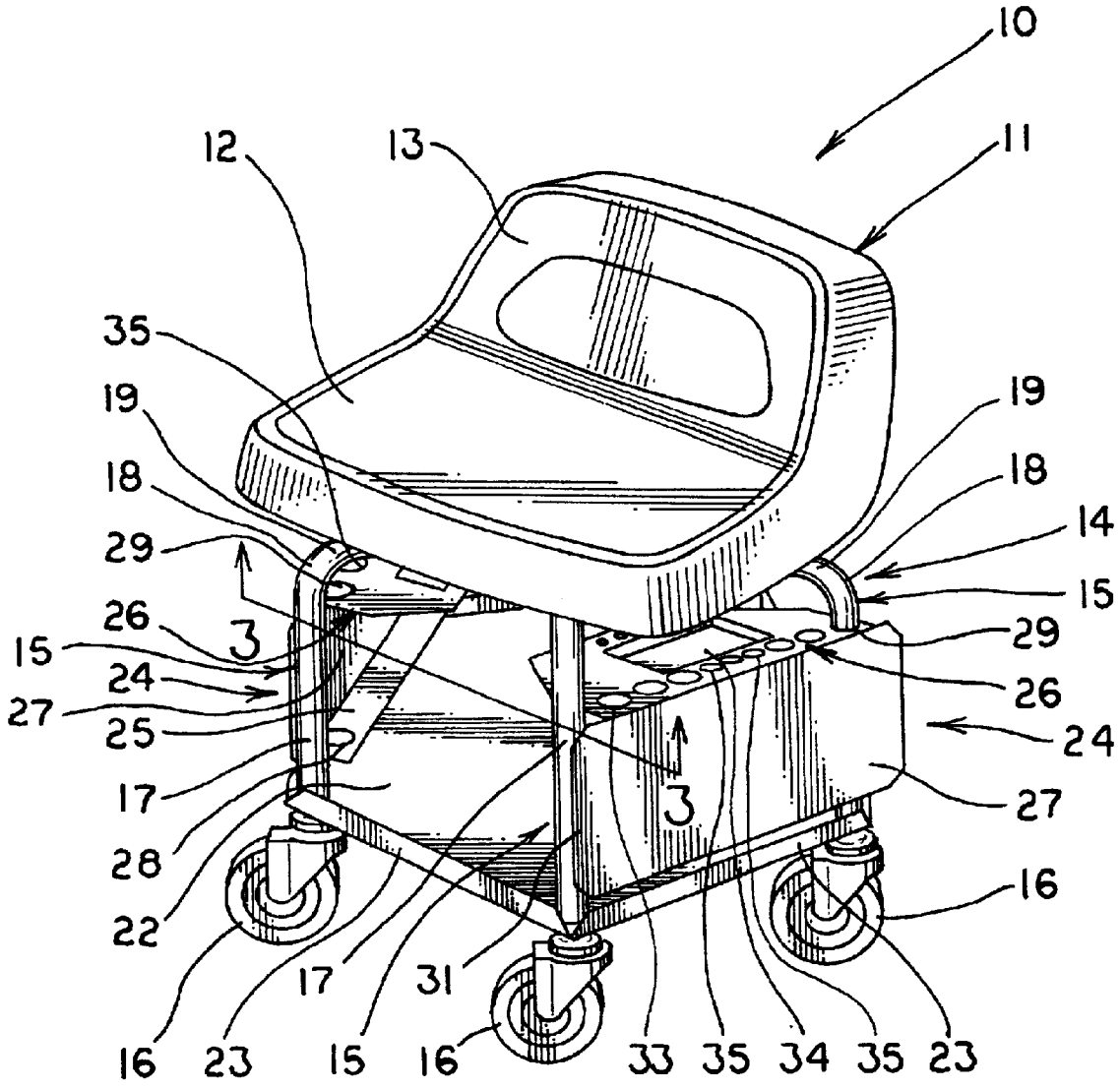
FIG. 1 is a perspective view of a chair for a mechanic's creeper made in accordance with the concepts of the present invention.

A mobile chair made in accordance with the concepts of the present invention is generally indicated by the numeral 10, and while it is particularly adapted to be used by a mechanic or the like while working on a vehicle, the usages for chair 10 are not so limited. Mobile chair 10 includes a padded chair, generally indicated by the numeral 11, having a seat portion 12 and a backrest portion 13 extending upwardly from the upper surface of seat portion 12.

Chair 11 is supported by a base assembly, generally indicated by the numeral 14, which is preferably made of a metallic material and which includes a plurality of legs generally indicated by the numeral 15. As shown, preferably there are five legs 15 for chair 10 rendering it very mobile and very stable irrespective of the direction of movement established for it by the user. A conventional caster assembly 16 may be provided at the foot of each leg 15 to render chair 10 readily mobile, as just described. Each leg 15 also includes a generally vertical portion 17 extending upwardly from caster assembly 16. Portion 17 thus elevates padded chair 11 above the ground. At the top of each vertical portion 17, each leg 15 bends approximately ninety degrees, as at 18, and terminates as a horizontal portion 19 supporting seat portion 12. Horizontal portions 19 are tied together by being welded, or otherwise attached, to a plate 20 which may be attached, as by fasteners 21, to the underside of the lower surface of seat portion 12. As a result, legs 15 carry padded chair 11 for controlled movement on caster assemblies 16.

Chair base assembly 14 also includes a shelf 22 carried by legs 15 near the bottom of chair 10. Shelf 22 may be provided with a peripheral flange 23 extending upwardly therefrom so as to enable shelf 22 to carry items for access by the user of chair 10. As a result, flange 23 prevents such items from falling off of shelf 22. Shelf 22 is shown as being pentagonal in shape, to conform to the five-leg configuration of chair base assembly 14, with its five corners each having an aperture to receive leg vertical portions 17 therethrough. As a result, shelf 22 is supported from lateral movement by legs 15 and is supported vertically on the tops of caster assemblies 16. If so desired, shelf 22 may be welded or otherwise affixed to legs 15, or it could be slidably received on legs 15 to be thereby liftable off of caster assemblies 16 if desired.

Chair base assembly 14 may also be provided with one or more pivotable trays generally indicated by the numeral 24, two such trays being shown. For economy of manufacture and installation, each tray 24 is preferably identical and includes a generally horizontally extending lower support flange 25, vertically spaced from a horizontally extending upper tray portion, generally indicated by the numeral 26, by a generally vertically extending side plate 27.

Figure 2:
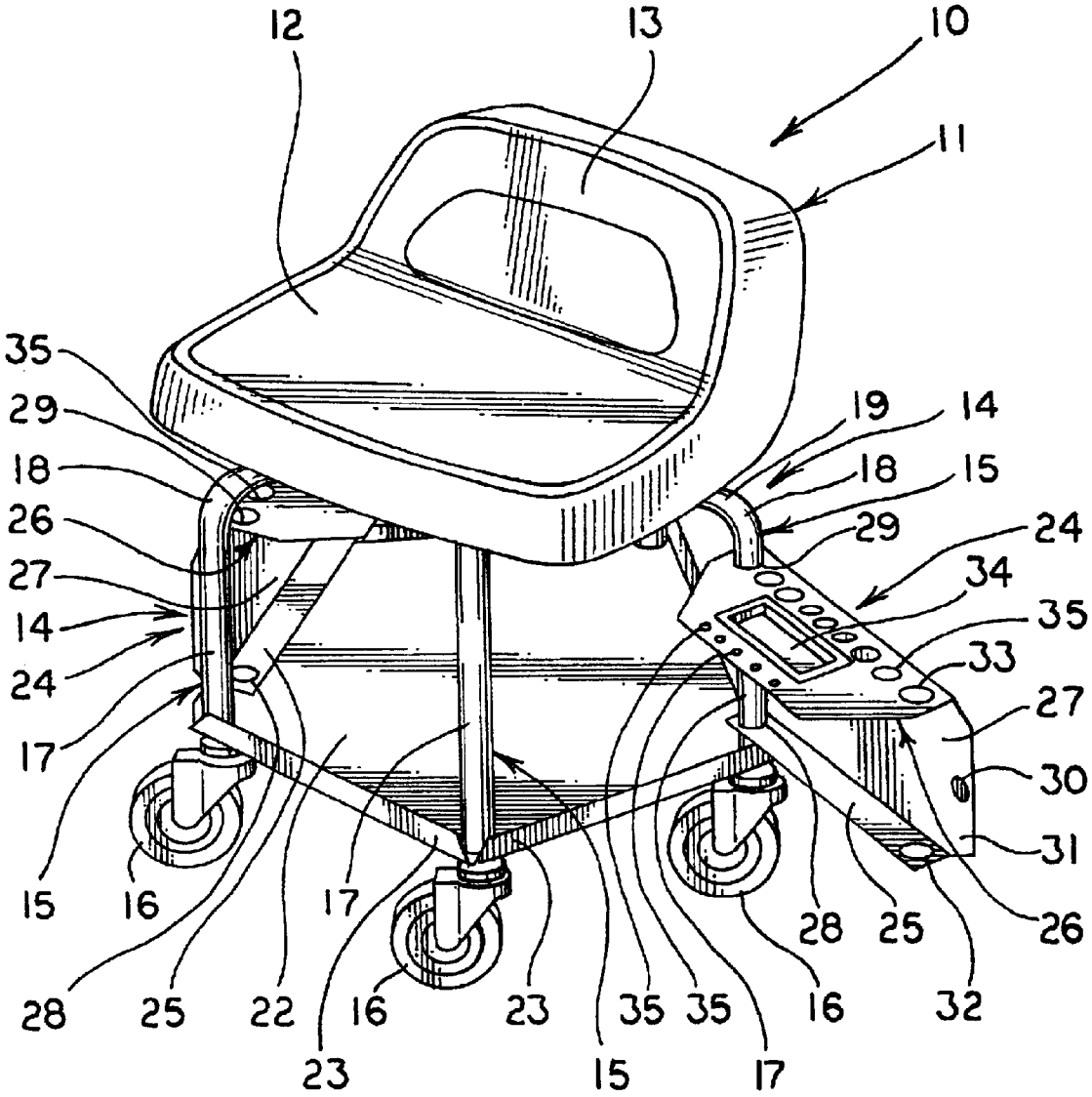
FIG. 2 is a perspective view similar to FIG. 1 but showing a tool storage tray in an extended position.
Figure 3:
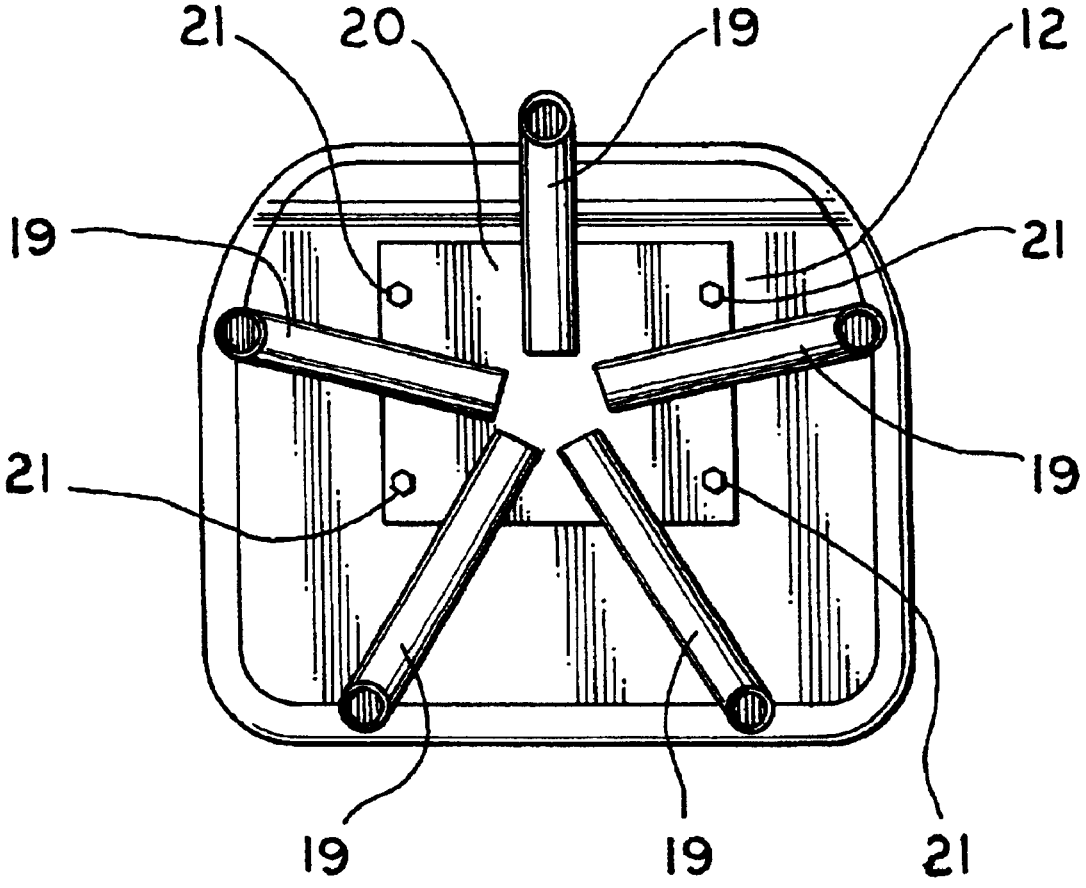
FIG. 3 is a sectional view taken substantially along line 3—3 of FIG. 1.

Each tray 24 is pivotally mounted on a leg 15. To that end, lower flange 25 is provided with an aperture 28 aligned with an aperture 29 in upper tray portion 26 through which a leg 15 is positioned. Tray 24 is thus pivotable on a leg 15 from a closed position underneath seat portion 12 as shown in FIG. 1 to an open position laterally to the side of seat portion 12 as shown in FIG. 2. Each tray 24 may be maintained in the closed position by a magnet 30, or other attaching device such as a hook and loop fastener, positioned on a lip 31 of side plate 27 which extends laterally beyond lower flange 25 and upper tray portion 26. Thus, magnet 30 will engage the leg 15 adjacent to the leg 15 on which tray 24 is pivoting, to hold tray 24 in the closed position at which time upper tray portion 26 and lower flange 25 are located between adjacent legs 15 and under chair seat 12. So that the same tray 24 can be mounted for pivoting movement on any leg 15, a second set of opposed leg receiving apertures 32, 33, is provided on lower flange 25 and tray portion 26, respectively, at the ends thereof opposed to apertures 28 and 29.

Upper tray portion 26 is adapted to carry items for ready access by the user of chair 10. To that end, tray portion 26 may be configured in many different fashions, such as having a recessed compartment 34 formed therein to hold small tools or other small items such as fasteners or the like. Tray portion 26 may also have a plurality of holes 35 extending therethrough, through which handled tools may be hung for ready access. As a result, smaller items of tools and supplies may be carried by trays 24, with larger items being conveniently maintained on shelf 22.

It should thus be evident that a chair constructed in accordance with the description herein accomplishes the objects of the present invention and otherwise substantially improves the art.

What is claimed is:

1. A chair comprising a seat portion having an upper and lower surface, a backrest portion extending upwardly from said upper surface of said seat portion, a plurality in excess of four legs, each of said legs having a first end and a second end, and having a generally vertical portion extending from said first end toward one end of a generally horizontal portion, said second end being located at an end of said horizontal portion opposed to said one end, a caster assembly carried at said first end of each of said legs, said horizontal portion of each of said legs being attached to the underside of said lower surface of said seat portion, and a shelf having a plurality of corners corresponding in number to the number of said plurality of legs, individual of said corners being attached to individual of said legs.

2. The chair according to claim 1 wherein each of said corners is provided with an aperture to receive one of said legs.

3. The chair according to claim 1 wherein said shelf rests on said caster assemblies.

4. A chair comprising a seat portion having an upper and lower surface, a backrest portion extending upwardly from said upper surface of said seat portion, a plurality in excess of four legs, each of said legs having a first end and a second end, and having a generally vertical portion extending from said first end toward one end of a generally horizontal portion, said second end being located at an end of said horizontal portion opposed to said one end, a caster assembly carried at said first end of each of said legs, said horizontal portion of each of said legs being attached to the underside of said lower surface of said seat portion, and a tray assembly pivotally carried by one of said legs.

5. A chair comprising a seat portion having an upper and lower surface, a backrest portion extending upwardly from said upper surface of said seat portion, a plurality in excess of four legs, a caster assembly carried at one end of each of said legs, said legs being configured so as to be attached at their other end to the underside of said lower surface of said seat portion, and a tray assembly pivotally carried by one of said legs, said tray assembly including a lower flange, an upper tray, and a plate positioned between said upper tray and said lower flange, said lower flange and said upper tray having aligned apertures to receive said one of said legs.

6. A chair comprising a seat portion having an upper and lower surface, a backrest portion extending upwardly from said upper surface of said seat portion, a plurality in excess of four legs, a caster assembly carried at one end of each of said legs, said legs being configured so as to be attached at their other end to the underside of said lower surface of said seat portion, and a tray assembly pivotally carried at least at two locations by one of said legs so as to be movable toward and away from and to be attachable to another of said legs, said tray assembly including a tray having a compartment adapted to receive and hold items.

7. A chair comprising a seat portion, a backrest portion extending upwardly from said seat portion, a plurality of legs carrying said seat portion, and at least one tray assembly pivotally carried at more than one vertical location on one of said legs and attachable to another leg which is adjacent to said one of said legs, said tray assembly including a lower flange, an upper tray, and a plate positioned between said upper tray and said lower flange, said more than one location being defined by aligned apertures in said lower flange and said upper tray, said apertures receiving said one of said legs.

8. A chair comprising a seat portion, a backrest portion extending upwardly from said seat portion, a plurality of legs carrying said seat portion, at least one tray assembly pivotally carried by one of said legs and attachable to another leg which is adjacent to said one of said legs, said tray assembly including a tray carried by a plate, said plate including a lip, and a magnet on said lip to attach said tray assembly to said leg which is adjacent to said one of said legs.

9. The chair according to claim 8 wherein said tray has holes therethrough adapted to receive items.

10. The chair according to claim 8 further comprising a shelf carried by said legs.

11. The chair according to claim 10 further comprising a caster assembly positioned at one end of each of said legs, said shelf resting on said caster assemblies.

12. A chair comprising a seat portion, a backrest portion extending upwardly from said seat portion, a plurality of legs carrying said seat portion, and at least one tray assembly pivotally carried by one of said legs and being attachable to another leg which is adjacent to said one of said legs, and a shelf including a plurality of corners corresponding in number to the number of said plurality of legs, individual of said corners being attached to individual of said legs.

13. The chair according to claim 12 wherein each of said corners is provided with an aperture to receive one of said legs.

* * * * *